US006300287B1

(12) United States Patent
Ishikawa et al.

(10) Patent No.: US 6,300,287 B1
(45) Date of Patent: Oct. 9, 2001

(54) PARTING AGENT FOR COPIER TONER

(75) Inventors: Hiroki Ishikawa; Tsutomu Naganawa; Isao Ona, all of Chiba Prefecture (JP)

(73) Assignee: Dow Corning Toray Silicone Company, Ltd., Tokyo (JP)

( * ) Notice: Subject to any disclaimer, the term of this patent is extended or adjusted under 35 U.S.C. 154(b) by 0 days.

(21) Appl. No.: 09/559,709

(22) Filed: Apr. 27, 2000

Related U.S. Application Data

(63) Continuation-in-part of application No. 09/200,074, filed on Nov. 25, 1998, now abandoned.

(30) Foreign Application Priority Data

Nov. 28, 1997 (JP) ..... 9-344295

(51) Int. Cl.[7] ..... C10M 105/76

(52) U.S. Cl. ..... 508/204; 528/38; 556/425; 252/182.29; 252/182.3

(58) Field of Search ..... 528/38; 556/425; 252/182.29, 182.3; 508/204

(56) References Cited

U.S. PATENT DOCUMENTS 4,101,686 * 7/1978 Strella et al. ..... 427/22
5,625,025 * 4/1997 Ishikawa et al. ..... 528/28
5,780,545 * 7/1998 Chen et al. ..... 524/860

FOREIGN PATENT DOCUMENTS 58-52589 11/1983 (JP) .
59-4699 1/1984 (JP) .
1-204085 8/1989 (JP) .

* cited by examiner

*Primary Examiner*—Margaret G. Moore
(74) *Attorney, Agent, or Firm*—Robert L. McKellar; James L. De Cesare

(57) ABSTRACT

A parting agent for a copier toner is disclosed. The parting agent exhibits no loss of parting properties or generation of gel under high-temperature conditions near 200° C., and causes no problems with paper feed or the like. The parting agent is composed of a diorganopolysiloxane of the average unit formula: $R_aSiO_{4-a/2}$, where the R groups are the same or different and are substituted or unsubstituted monovalent hydrocarbon groups, with at least 50 mol % of the R groups being methyl groups, and $1.95 \leqq a \leqq 2.20$. The diorganopolysiloxane has a viscosity of 10 to 100,000 centistokes at 25° C., and generates no more than 5 ppm (by weight) of formaldehyde per hour when kept at 200° C. in an air atmosphere.

1 Claim, No Drawings

PARTING AGENT FOR COPIER TONER

This application is a continuation-in-part of Ser. No. 09/200,074, Nov. 25, 1998 now abandoned.

FIELD OF THE INVENTION

This invention relates to a parting agent for a toner used in a copier. More particularly, this invention relates to a copier toner parting agent which does not lose any of its parting properties or turn into a gel under high-temperature conditions near 200° C., and which does not cause any problems with paper feed or the like.

BACKGROUND OF THE INVENTION

Because of their excellent heat resistance and parting properties, organopolysiloxanes are commonly used as parting agents for copier toners. However, when dimethylpolysiloxane, a typical organopolysiloxane, is used as a toner parting agent, the methyl groups in the dimethylpolysiloxane gradually begin to be pyrolyzed in the vicinity of 150° C. Pyrolysis becomes quite sudden at high temperatures over 200° C., which leads to diminished parting properties and generation of gel, which causes problems with paper feed, for example.

A toner parting agent composed of a mercapto group-containing organopolysiloxane or a carboxyl group-containing organopolysiloxane has been proposed in an effort to solve these problems (Japanese Patent Publication 58-52589). A toner parting agent composed of a mixture of an amino group-containing organopolysiloxane and dimethylpolysiloxane has also been proposed (Japanese Patent Publication 59-4699). There has also been a proposal for enhancing the heat resistance of a toner parting agent by adding iron, copper, or another redox type metal or metal compound to dimethylpolysiloxane (see Japanese Laid-Open Patent Application 1-204085). These toner parting agents, however, are not entirely satisfactory, and there is a need for a parting agent for a copier toner without these problems.

One object of this invention is to provide a parting agent for a copier toner, which has no loss of parting properties or generation of gel under high-temperature conditions near 200° C., and which causes no problems with paper feed or the like. These objects can be met by keeping the amount of formaldehyde generated during exposure to high temperatures within a specific range with an organopolysiloxane used as a toner parting agent.

SUMMARY OF THE INVENTION

This invention relates to a parting agent for a copier toner. The parting agent comprises a diorganopolysiloxane having the average unit formula: $R_aSiO_{4-a/2}$, where the R groups are substituted or unsubstituted monovalent hydrocarbon groups that are the same or different, and where at least 50 mol % of the R groups are methyl groups, and $1.95 \leqq a \leqq 2.20$. The diorganopolysiloxane has a viscosity of 10 to 100,000 centistokes at 25° C. and generates no more than 5 ppm by weight of formaldehyde per hour when kept at 200° C. in an air atmosphere.

DETAILED DESCRIPTION OF THE INVENTION

The diorganopolysiloxane used in this invention has the average unit formula: $R_aSiO_{4-a/2}$, where the R groups are substituted or unsubstituted monovalent hydrocarbon groups that are the same or different, and $1.95 \leqq a \leqq 2.20$. Examples of R include methyl, ethyl, propyl, butyl, pentyl, hexyl, heptyl, octyl, decyl, dodecyl, tetradecyl, or other saturated aliphatic hydrocarbon groups; cyclopentyl, cyclohexyl, or other saturated alicyclic hydrocarbon groups; phenyl, tolyl, naphthyl, or other aromatic hydrocarbon groups; or a group in which the hydrogen atoms bonded to the carbon atoms in these groups have been partially substituted with an organic group including an epoxy group, carboxyl group, mercapto group, or the like; or a halogen atom. Preferably, R to has between 1 and 20 carbon atoms. At least 50 mol % of these R groups are methyl groups, and preferably, at least 95 mol % are methyl groups.

This diorganopolysiloxane must have a viscosity of 10 to 100,000 centistokes at 25° C., and preferably 10 to 60,000 centistokes. When the diorganopolysiloxane is kept at 200° C. in an air atmosphere, the amount of formaldehyde generated per hour must be no more than 5 ppm by weight. It is also preferable for the content of siloxane oligomer having 20 silicon atoms or less to be 3000 ppm or less.

Preferably, 0.0001 to 1 mol % of the R groups in the average unit formula are organic groups of General Formula (1) to suppress the generation of formaldehyde.

$$—R^1—C_6H_xR^2_{(4-x)}OH \qquad \text{General Formula (1):}$$

where R is a divalent hydrocarbon group. Examples of suitable divalent hydrocarbon groups include ethylene, propylene, butylene, methylpropylene, or other such alkylene group, and alkylene-arylene groups expressed by the formula $—(CH_2)_2C_6H_4$. Ethylene and propylene groups are preferred. Examples of $R^2$ include the same substituted and unsubstituted monovalent hydrocarbon groups as given for R above, hydroxyl groups, methoxy groups, ethoxy groups, or other alkoxy group. The subscript x is an integer from 0 to 4.

Specific examples of the organic groups of General Formula (1) include the following.

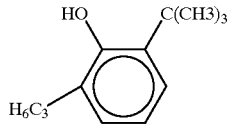

,

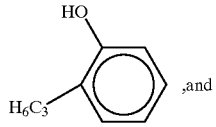

,and

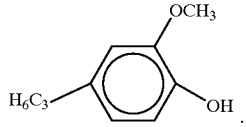

.

Preferably, 0.0001 to 1 mol % of the R groups in the above average unit formula are organic groups of General Formula (2) to suppress the generation of formaldehyde $$—R—NHCH_2CH_2)_bNHR^3, \qquad \text{General Formula (2):}$$

where R is a divalent hydrocarbon group as described above. $R^3$ is a hydrogen atom or a monovalent hydrocarbon group, examples of which include methyl, ethyl, phenyl, and cyclohexyl groups. The subscript b is an integer from 0 to 10.

Specific examples of organic groups of General Formula (2) include the following organic groups.

—$CH_2CH_2CH_2NHCH_2CH_2NH_2$

—$CH_2CH_2CH_2NH_2$

—$CH_2CH(CH_3)CH_2NHCH_2CH_2NH_2$

—$CH_2CH_2CH_2NHC(CH_3)_3$

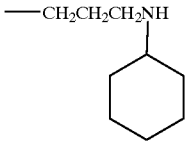

The content of organic groups having General Formula (1) or (2) should be such that the molecular weight (equivalents) of the diorganopolysiloxane per phenolic hydroxyl group or per amino group (—$NH_2$ or —NH—)is between 10,000 and 5,000,000, and preferably between 50,000 and 500,000. If there are fewer than 10,000 equivalents, intermolecular crosslinking will tend to occur between the phenol groups or amino groups and the material will be more prone to gelling, which is disadvantageous from a cost standpoint. If 5,000,000 is exceeded, the amount of formaldehyde that is generated will not be suppressed sufficiently.

A diorganopolysiloxane containing organic groups expressed by General Formula (1) or (2) can be manufactured by a known method. To manufacture the targeted diorganopolysiloxane, a diorganopolysiloxane containing groups expressed by General Formula (1) or (2) and a diorganopolysiloxane not containing groups expressed by General Formula (1) or (2) may each be manufactured separately, and then these two types of diorganopolysiloxane may be blended in suitable amounts.

When a diorganopolysiloxane not containing organic groups of General Formula (1) or (2) is used for the copier toner parting agent, it is preferable to add an organic antioxidant to the diorganopolysiloxane to suppress formaldehyde generation.

It is most effective for the antioxidant to be a phenol-based antioxidant or an amine-based antioxidant classified as a radical chain inhibitor, or a diorganopolysiloxane containing aromatic amino groups selected from the following formulas.

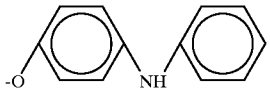

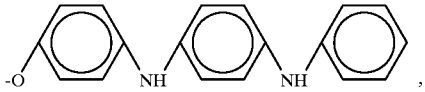

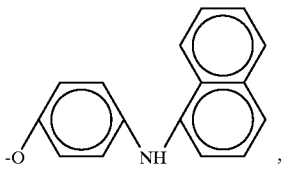

and

-continued

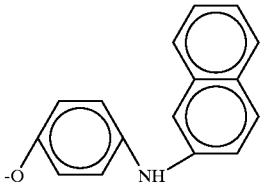

Examples of these antioxidants include phenyl-α-naphthylamine, α-naphthylamine, N,N'-diphenyl-p-phenylenediamine, N,N'-di-t-butyl-p-phenylenediamine, phenothiazine, and other such amino-based antioxidants, and 2,6-di-t-butyl-p-cresol, 2,6-di-t-butylphenol, 2,4-dimethyl-6-t-butylphenol, 2,2'-methylenebis(4-methyl-6-t-butylphenol), 4,4'-thiobis(3-methyl-6-t-butylphenol), and other such phenol-based antioxidants. Examples of diorganopolysiloxanes containing groups of the above formulas include the following compounds.

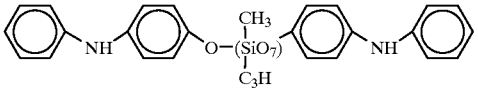

and

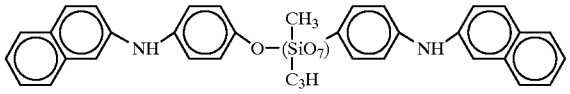

These antioxidants are added in amounts of 0.001 to 5.0 wt %, preferably 0.01 to 1.0 wt %, per 100 weight parts of diorganopolysiloxane.

The diorganopolysiloxane in this invention must generate no more than 5 ppm of formaldehyde by weight per hour. The amount of formaldehyde generation can be quantified by the following method, for example.

1.0 g of diorganopolysiloxane is weighed out in a heating vessel equipped with an air introduction tube, and is placed in a heating apparatus that can be heated to 200° C. The diorganopolysiloxane is kept at 200° C. for 5 hours while air is allowed to flow through the heating vessel at a flux of 100 mL/min. The gas that is discharged from the heating vessel is introduced into two collector pipes containing 10 mL of a 0.2% 2N-hydrochloric acid solution of 2,4-dinitrophenylhydrazine, and the formaldehyde is collected through derivative conversion. The derivative in the two collector pipes is then extracted with 4 mL of chloroform, after which it is analyzed by high performance liquid chromatography (HPLC) to determine the total amount of formaldehyde generated in 5 hours, in units of ppm (μg/g). The value obtained is divided by five to find the amount of formaldehyde generated per hour.

The copier toner parting agent of the present invention does not lose any of its parting properties or turn into a gel under high-temperature conditions near 200° C., and does not cause any problems with paper feed or the like, and as such is extremely effective as a parting agent for a copier toner of which such characteristics are required.

EXAMPLES

These examples are intended to illustrate the invention to those skilled in the art and should not be interpreted as limiting the scope of the invention set forth in the claims. In these examples, viscosity is measured at 25° C., and 'cSt' means centistokes. The amount of formaldehyde generation, the change in viscosity, and the parting properties were measured by the following methods.

Measurement of the Amount of Formaldehyde Generation 1.0 g of diorganopolysiloxane was weighed out in a heating vessel equipped with an air introduction tube, and was placed in a heating apparatus that could be heated to 200° C. Here, the air introduction inlet was in a state in which it was not immersed in the diorganosiloxane liquid. The diorganopolysiloxane was kept at 200° C. for 5 hours while air was allowed to flow through the heating vessel at a flux of 100 mL/min. During this time, the gas that was discharged from the heating vessel was introduced into two collector pipes containing 10 mL of a 0.2% 2N-hydrochloric acid solution of 2,4-dinitrophenylhydrazine, and the formaldehyde was collected through derivative conversion. Here, the two collector pipes were linked in series, and the gas introduction inlet was adjusted such that it would be immersed in the collected liquid. The derivative in the two collector pipes was extracted with 4 mL of chloroform, after which it was analyzed by high performance liquid chromatography (HPLC) to determine the total amount of formaldehyde generated in 5 hours, in units of ppm ($\mu$g/g). The value thus obtained was divided by five to find the amount of formaldehyde generated per hour.

Change in Viscosity 30 g of diorganopolysiloxane was put in a 100 mL beaker, and this beaker was covered with a 300 mL beaker and left in a 200° C. hot air circulation type oven. The diorganopolysiloxane was taken out after a specific length of time, and its viscosity was measured. The viscosity was measured with an E-type rotary viscometer.

Parting Properties

A styrene acrylic resin powder used for a copier toner was spread out in a thin, uniform layer on an ordinary sheet of paper. Also, the diorganopolysiloxane serving as the parting agent for a copier toner was rubbed onto a silicone rubber sheet (10×10×2 mm) in a thin, uniform coating with a cloth. This silicone rubber sheet was placed over the ordinary paper covered with the styrene acrylic resin, with the side coated with the diorganopolysiloxane facing down. This was pressed for 5 minutes in a pressing machine at 180° C. and a pressure of 50 kg/cm$^2$. The silicone rubber sheet was then peeled away from the ordinary paper, and the silicone rubber sheet was checked to see how much of the styrene acrylic resin powder had migrated to it.

Reference Example 1

Manufacture of Diorganopolysiloxane A 97.8 weight parts of trimethylsiloxy-terminated dimethylpolysiloxane with a viscosity of 315 cSt was mixed with 2.2 weight parts of phenol group-containing diorganopolysiloxane of the formula

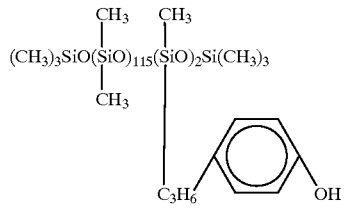

and having a viscosity of 330 cSt and a phenol equivalent of 4,530; to manufacture a diorganopolysiloxane A having a viscosity of 316 cSt and an average phenol equivalent of 205,900.

Reference Example 2

Manufacture of Diorganopolysiloxane B 898.4 g of cyclic polydimethylsiloxane, 100.0 g of trimethylsiloxy-terminated dimethylpolysiloxane with a viscosity of 10 cSt, and 1.6 g of hydrolyzed cyclohexylaminopropylmethyldimethoxysilane were put into a 1.2 L flask, the temperature was raised to 140° C. in a nitrogen atmosphere, and 0.2 g of potassium hydroxide was added. The contents were kept at 140° C. for 6 hours, after which 0.25 g of acetic acid was added to neutralize the system. The low-boiling matter was removed at 150° C. and 10 mmHg, and the neutral salts were removed by filtration. This yielded a diorganopolysiloxane B of the following formula and having a viscosity of 291 cSt and an average phenol equivalent of 122,400.

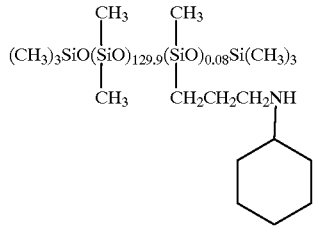

Reference Example 3

Manufacture of Diorganopolysiloxane C 99.8 weight parts of trimethylsiloxy-terminated polydimethylsiloxane with a viscosity of 315 cSt was mixed with 0.2 weight parts of aromatic amino group-containing diorganopolysiloxane of the formula

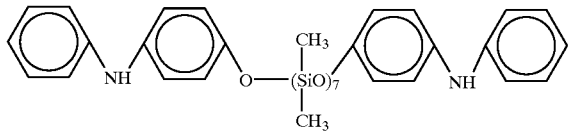

which yielded a diorganopolysiloxane C having a viscosity of 315 cSt.

Reference Example 4

Manufacture of Diorganopolysiloxane D 0.1 weight part of N,N'-di-t-butyl-p-phenylenediamine was added to and mixed with 99.9 weight parts of trimethylsiloxy-terminated polydimethylsiloxane with a viscosity of 315 cSt, which yielded a diorganopolysiloxane D having a viscosity of 315 cSt.

for a trimethylsiloxy-terminated polydimethylsiloxane with a viscosity of 315 cSt, and these results are also given in Table 1 as Comparative Example 1.

TABLE 1

| | Example 1 | Example 2 | Example 3 | Example 4 | Example 5 | Comp. Example 1 |
|---|---|---|---|---|---|---|
| Polyorganosiloxane | A | B | C | D | E | — |
| Amount of formaldehyde generation (ppm) | 2.3 | 2.4 | 2.9 | 3.2 | 3.1 | 7.2 |
| Change in viscosity (cSt) | | | | | | |
| Initial viscosity | 314 | 290 | 313 | 313 | 313 | 313 |
| After 200 hours | 317 | 298 | 316 | 320 | 321 | 3050 |
| After 500 hours | 376 | 380 | 388 | 411 | 406 | gelled |
| Parting properties | Styrene acrylic resin did not migrate onto silicone rubber sheet; parting properties good | Styrene acrylic resin did not migrate onto silicone rubber sheet; parting properties good | Styrene acrylic resin did not migrate onto silicone rubber sheet; parting properties good | Styrene acrylic resin did not migrate onto silicone rubber sheet; parting properties good | Styrene acrylic resin did not migrate onto silicone rubber sheet; parting properties good | Styrene acrylic resin did not migrate onto silicone rubber sheet; parting properties good |
| Overall evaluation | Good | good | good | good | good | poor |

Reference Example 5

Manufacture of Diorganopolysiloxane E 0.1 weight part of 2,6-di5-butyl-p-cresol was added to and mixed with 99.9 weight parts of trimethylsiloxy-terminated polydimethylsiloxane with a viscosity of 315 cSt, which yielded a diorganopolysiloxane E having a viscosity of 315 cSt.

Reference Example 6

Manufacture of Diorganopolysiloxane F 98.5 weight parts of trimethylsiloxy-terminated polydimethylsiloxane with a viscosity of 10,500 cSt was mixed with 1.5 weight parts of phenol group-containing diorganopolysiloxane of the formula

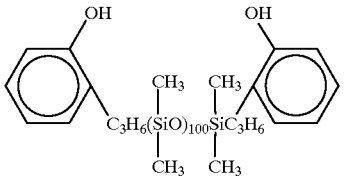

and having a viscosity of 240 cSt and a phenol equivalent of 3,860 to manufacture a diorganopolysiloxane F having a viscosity of 9,950 cSt and an average phenol equivalent of 257,300.

Examples 1 to 5

The amount of formaldehyde generation, the change in viscosity, and the parting properties were measured for diorganopolysiloxanes A to E obtained in Reference Examples 1 to 5, and the results are in Table 1.

Comparative Example 1

The amount of formaldehyde generation, the change in viscosity, and the parting properties were similarly measured

Example 6

The amount of formaldehyde generation, the change in viscosity, and the parting properties were measured for diorganopolysiloxane F obtained in Reference Example 6, and the results of this measurement are given in Table 2 as Example 6.

Comparative Example 2

The amount of formaldehyde generation, the change in viscosity, and the parting properties were similarly measured for a trimethylsiloxy-terminated polydimethylsiloxane with a viscosity of 10,500 cSt, and these results are given in Table 2 as Comparative Example 2.

TABLE 2

| | Example 6 | Comparative Example 2 |
|---|---|---|
| Polyorganosiloxane | F | — |
| Amount of formaldehyde generation (ppm) | 2.4 | 7.4 |
| Change in viscosity (cSt) | | |
| Initial viscosity | 9,940 | 10,350 |
| After 200 hours | 9,500 | 21,400 |
| After 400 hours | 9,330 | gelled |
| Parting properties | Styrene acrylic resin did not migrate onto silicone rubber sheet; parting properties good | Styrene acrylic resin did not migrate onto silicone rubber sheet; parting properties good |
| Overall evaluation | good | poor |

Example 7

The diorganopolysiloxane B obtained in Reference Example 2 was applied to a copier that used A4-size copy paper made by Fuji Xerox, trade name A Color 636. There was no image disturbance even after 5000 sheets of A4-size ordinary paper had passed through, and the parting properties were good.

We claim:

1. A parting agent for a copier toner comprising a diorganopolysiloxane having an average unit formula of $R_aSiO_{4-a/2}$ where each R is independently selected from the group consisting of substituted and unsubstituted monovalent hydrocarbon groups, and a has a value of 1.95> or =a>=2.20, provided at least 50 mol % of the R groups are methyl groups; the diorganopolysiloxane having a viscosity of 10–100,000 centistokes at 25° C., and there is present at least 0.0001–1.00 mol % of R groups having the average unit formula $—R^1—(NHCH_2CH_2)_bNHR^3$, where $R^1$ is a divalent hydrocarbon group; $R^3$ is selected from the group consisting of a hydrogen atom and a monovalent hydrocarbon group; and b is 0–10; the parting agent further comprising a diorganopolysiloxane antioxidant selected from the group consisting of

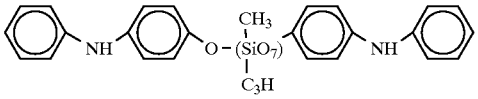

and

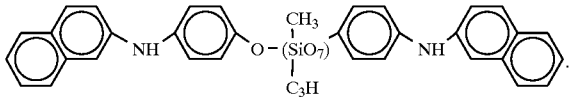

* * * * *